United States Patent [19]

Bruning et al.

[11] 4,299,353

[45] Nov. 10, 1981

[54] DRIVE FOR A CONTINUOUSLY OPERATING SCREW EJECTION CENTRIFUGAL SEPARATOR

[75] Inventors: Paul Bruning; Alfons Monkenbusch, both of Oelde, Fed. Rep. of Germany

[73] Assignee: Westfalia Separator AG, Oelde, Fed. Rep. of Germany

[21] Appl. No.: 21,856

[22] Filed: Mar. 19, 1979

[30] Foreign Application Priority Data

Mar. 18, 1978 [DE] Fed. Rep. of Germany ..... 2811887

[51] Int. Cl.[3] ..... B04B 1/20

[52] U.S. Cl. ..... 233/7; 233/24

[58] Field of Search ..... 233/7, 9, 23 R, 24, 233/1 R, 3, 6

[56] References Cited

U.S. PATENT DOCUMENTS

| | | | |
|---|---|---|---|
| 2,867,378 | 1/1959 | Harlow | 233/7 |
| 3,501,346 | 3/1970 | Katzen | 233/7 |
| 4,085,888 | 4/1978 | Jager | 233/7 |
| 4,129,249 | 12/1978 | Todd | 233/7 |

*Primary Examiner*—Robert W. Jenkins

*Attorney, Agent, or Firm*—Sprung, Felfe, Horn, Lynch & Kramer

[57] ABSTRACT

A continuously operating screw ejection centrifugal separator. The drum and the screw are driven by an epicyclic gear train. Changes in torque between the screw and the drum of the centrifuge are measured and the differential speed of the screw and drum is controlled so as to obtain substantially steady state operation of the separator. For the control, a second epicyclic gear train is associated with the first-mentioned epicyclic gear train.

5 Claims, 2 Drawing Figures

DRIVE FOR A CONTINUOUSLY OPERATING SCREW EJECTION CENTRIFUGAL SEPARATOR

BACKGROUND

Figure 1:
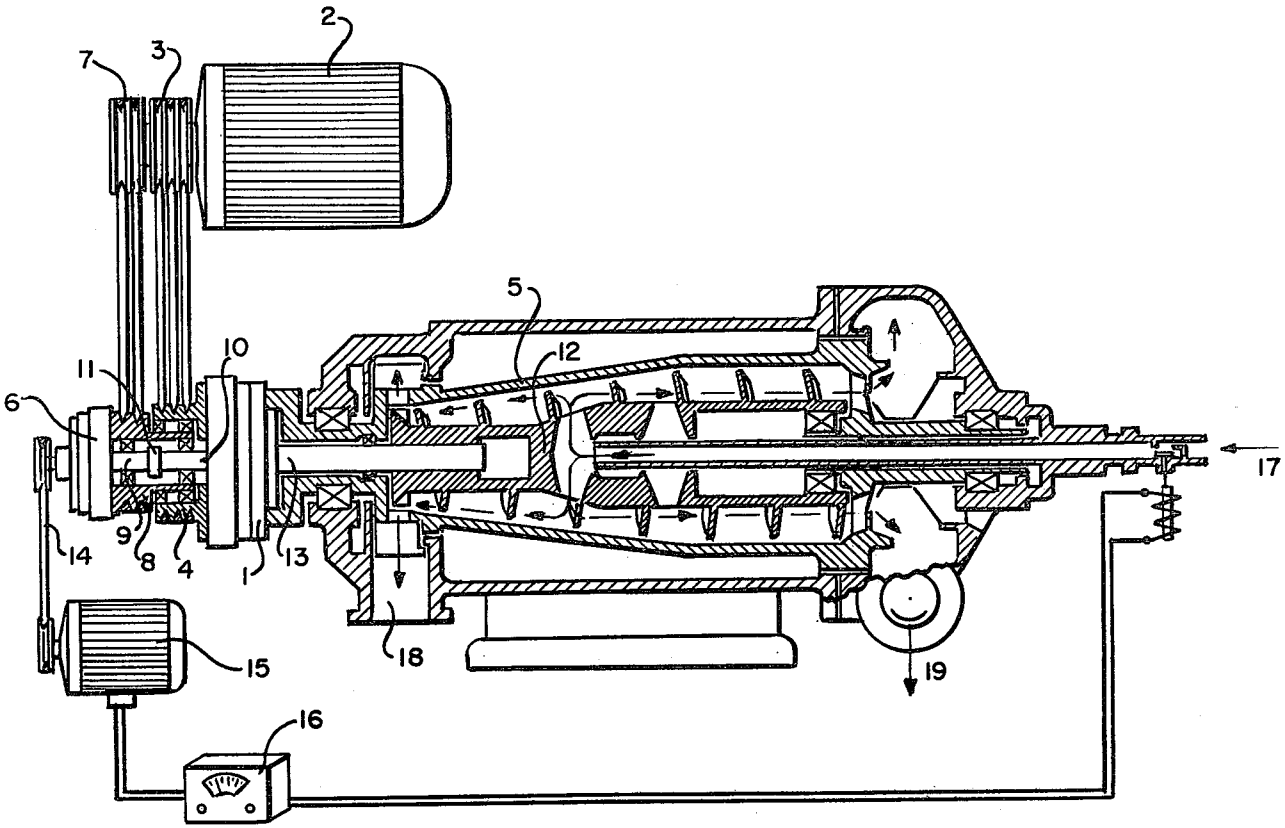

The invention relates to a drive for a continuously operating screw ejection centrifugal separator having an epicyclic gear train between the centrifuge drum and the ejector screw.

Such drives for screw ejection centrifugal separators are known, the centrifuge drum being driven directly by the motor and the ejector screw being driven by an epicyclic gear train, such as a planetary drive. It is unimportant whether the rotatory speed of the screw is greater or less than that of the centrifuge drum, as long as the relative movement between them produces a transport of the solids being separated in these separators towards the smaller end of the drum. The friction that is to be overcome by the screw has a tendency to reduce the differential rotatory speed between the drum and the screw, i.e., to drive the screw at the same speed as the drum. This torque depends on the nature and rate of flow of the material being separated, its solid content, and the length of the dry zone in the separator.

Screw ejection centrifugal separators are therefore often advantageously equipped with drives which are torque-controlled or with timed drives whenever the raw liquids to be separated vary in rate of flow and in solid content, and when the solid matter must satisfy special requirements with regard to residual moisture. The regulation and control of the separator are accomplished in this case by varying the rate of product input and/or the differential speed.

In known planetary drives, the input shaft of the gear train can be held and the applied torque measured, but variation of the differential speed during operation is not possible. Any necessary change in the differential speed would have to be accomplished by changing the transmission ratio in the gear train.

German Offenlegungsschrift No. 24 32 284 discloses a drive for continuously operating screw ejection centrifugal separators, in which the regulation of the differential speed between the screw and the centrifuge drum is accomplished through a hydrostatic drive, the screw being driven by a hydraulic motor revolving at the drum speed and the differential speed being dependent upon the volume of oil delivered to the hydraulic motor by a controllable pump. The reference magnitude for the control is the torque-related oil pressure.

Such hydrostatic drives are suitable especially for small and medium screw ejection separators. In the case of larger screw ejection separators, relatively high differential speeds cannot be achieved. The drive requires additional maintenance, and contamination due to leakage in the high pressure unit is not avoidable. Such drives are furthermore expensive and require a relatively great amount of space.

German Pat. No. 10 40 460 discloses the control of the speed of a screw ejection centrifugal separator by means of an eddy current brake in which the input shaft of the gear train is slowed by braking until the desired differential speed is reached. Within given limits, the slip and with it the differential speed can be kept constant by appropriate electrical manipulation at varying loads. If the limit is exceeded due to excessively high torque, an increase in the differential speed can be accomplished by varying the slip.

Rotatory speed control through an eddy current brake is also suitable only for smaller screw ejection centrifugal separators. In the transmission of higher torques, however, higher drive ratios are required, even though they diminish the range of control. Relatively great power losses develop, especially at the lower differential speeds, and explosion-proof separator designs are not possible.

Furthermore, screw drives are known in conjunction with controlled-speed motors, in which a continuous adjustment of the differential speed is possible, as well as a torque-related variation of the differential speed and/or of the product input. Such drives, however, are very expensive.

THE INVENTION

It is the object of the invention to eliminate the disadvantages mentioned above and to create a low-cost drive for screw ejection centrifugal separators with minimum power losses, for automatic, torque-related differential speed control or for time-related control of the differential speed.

This object is achieved in accordance with the invention in that a second epicyclic gear train is associated with the epicyclic gear train provided in a known manner, both epicyclic gear trains can be driven by one main drive motor through exchangeable V-belt sheaves, and the input shaft of the second epicyclic gear train is driven by a second motor connected to a measuring and regulating apparatus. Advantageously, the second epicyclic gear train is fixedly connected to the input shaft of the first epicyclic gear train through a stiff coupling, and is rotatably mounted in the casing of the first epicyclic gear train.

In a special embodiment, the second epicyclic gear train can be disposed in a separate bearing casing and can be connected directly to the main motor, while the power transmission to the first epicyclic gear train is accomplished by means of exchangeable V-belt sheaves.

A measuring and regulating apparatus connected with the second motor serves, when the torque is exceeded, to change the speed of the second motor, and for the regulation of the input of product to the centrifugal separator.

The system of the invention provides not only the necessary adjustability of the differential speed between the centrifuge drum and the screw, but also an indication of the torque loading with or without product input control, as well as an automatic, torque-related differential speed control. Since normal three-phase motors can be used, they can also be used in explosion-proof design. There are no special requirements with regard to the servicing and maintenance of this drive.

Since due to the selected transmission ratios no more than a small torque is applied to the input shaft of the second epicyclic gear train, the power required for the speed control and the power losses which it entails are also low.

Figure 2:
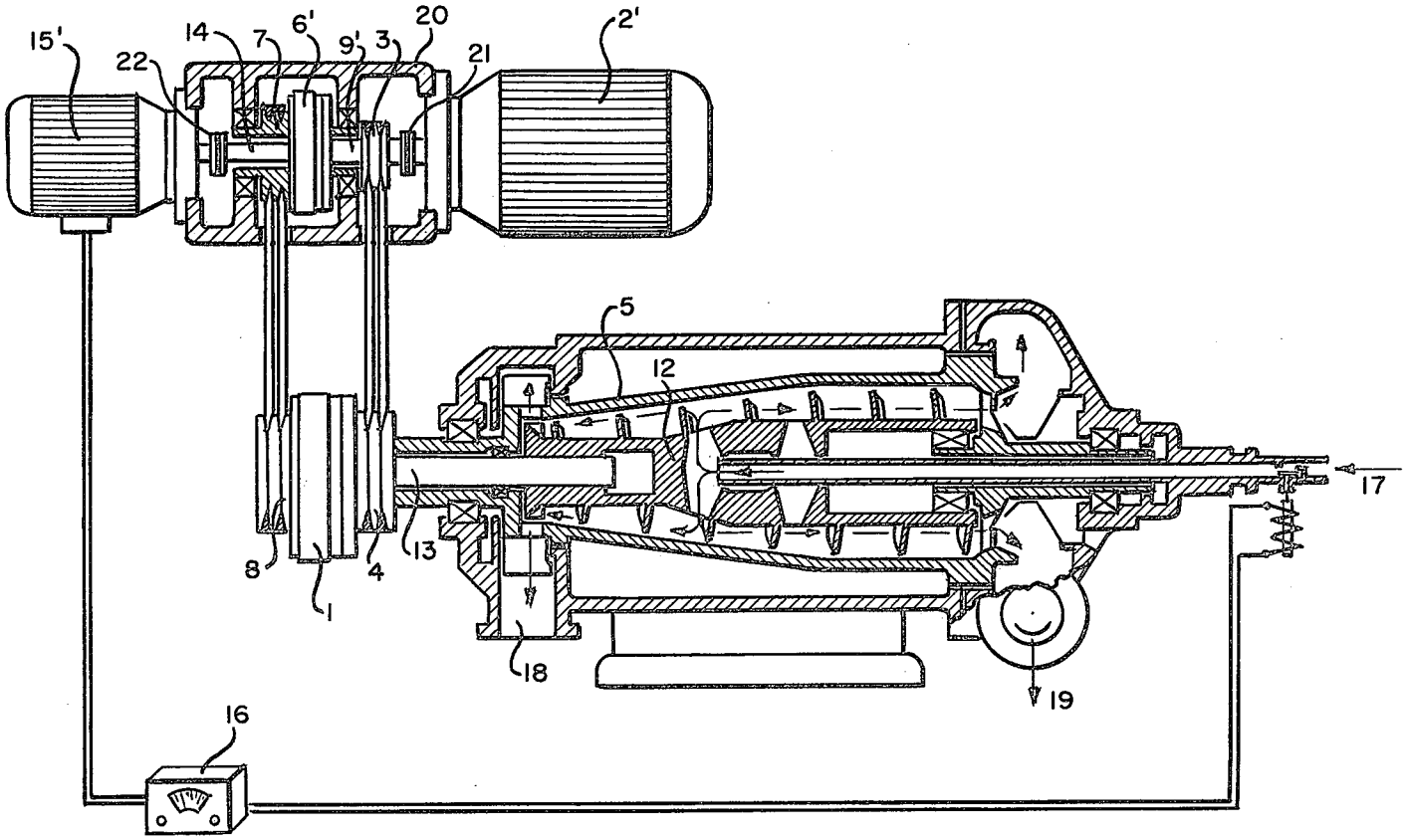

The manner of operation of this invention will be further described hereinbelow with the aid of the embodiments diagrammatically represented in the drawing, wherein:

FIG. 1 is a longitudinal cross section through a screw ejection centrifugal separator in which the second epicyclic gear train is fixedly joined to the first epicyclic gear train by a stiff coupling, FIG. 2 is a longitudinal cross section through a screw ejection centrifugal separator in which the second epicyclic gear train is disposed in a separate casing.

In FIG. 1, 1 designates an epicyclic gear train, for example a planetary gearing, which, when driven by the main motor 2 through exchangeable V-belt sheaves 3 and 4, drives the rotatably mounted centrifuge drum 5 at a set rotatory speed. In accordance with the invention, a second epicyclic gear train 6 is provided, the casing of which is driven by the main motor through exchangeable V-belt sheaves 7 and 8, and the output shaft 9 of the second epicyclic gear train is fixedly joined to the input shaft 10 of the first epicyclic gear train through a stiff coupling 11. The second epicyclic gear train is rotatably mounted in the casing of the first epicyclic gear train and drives the ejector screw 12 through shaft 13 at a set differential rotatory speed with respect to the centrifuge drum, in accordance with the transmission ratios between the sheaves 7 and 8 and the epicyclic gear trains 1 and 6.

The input shaft 14 of epicyclic gear train 6 is driven, for example, by a pole-changeable motor 15 at a set rotatory speed. The pole-changeable motor is connected to a measuring and regulating apparatus 16 which makes it possible to control the rotatory speed of the motor and/or to control the product input 17.

The drive operates as follows: In the embodiment represented, the screw 12 revolves, for example, at a higher speed than the centrifuge drum 5. The mixture of liquid and solid matter which is to be separated in a known manner in the centrifuge drum is put in at the product input 17, the solids being discharged from the separator at 18 and the clear phase at 19. For the transport of the solids within the centrifuge drum by the screw, various torques are required depending on the application and the conditions of operation. A portion of the torque prevailing at each moment between the screw and the centrifuge drum is transmitted by the input shaft 14 of the second epicyclic gear train 6 to the motor 15. This torque is indicated at the measuring apparatus 16 by a corresponding current draw by the motor and is dependent upon the rate of product input and/or on the prevailing concentration of the solids. As the product input increases and/or the solid concentration increases, the torque increases and with it the current draw of the motor. When a predetermined torque and hence current draw is exceeded, a change of the poles of the motor automatically takes place and hence a reduction of the speed of the motor and of the input shaft 14, which in turn undergoes a variation of the transmission ratio between the output shaft and casing of the second epicyclic gear train, and hence an increase in the screw speed and differential speed. Consequently the larger amount of solids being separated is removed more rapidly, whereupon the torque diminishes. If the current draw decreases due to reduced torque, another pole change again returns the motor 15 to its basic speed and hence to the basic differential speed between the screw and the centrifuge drum. If the current draw exceeds the preset maximum limit, additional measures can be taken, such as the throttling of the product inlet 17 or shutting off the main motor through the measuring and control apparatus 16.

If instead of a pole-changeable motor 15 a variable-speed motor is used, then the slightest change in the current will result in a reduction of the speed of the variable-speed motor, and thus an increase in the differential speed.

If the V-belt sheaves 7–8 are designed accordingly, a brake can also be used instead of the motor 15.

In FIG. 2, the second epicyclic gear train 6′ is mounted in a separate casing 20, the output shaft 9′ is fixedly joined to the main motor 2′ through a coupling 21, and the input shaft 14 is fixedly joined through a coupling 22 to a pole-changeable motor 15′. The centrifuge drum 5 is driven by the main motor through V-belt sheaves 3 and 4 and the screw is driven by means of V-belt sheaves 7 and 8 via the epicyclic gear train 1. The manner of operation of this drive is the same as described above with reference to FIG. 1.

What is claimed is:

1. In a continuously operating screw ejection centrifugal separator comprising a drum for holding material to be centrifuged and a screw in the drum for advancing separated material toward one end of the drum for the discharge thereof from the drum, an epicyclic gear train operatively connecting the drum and the screw for rotating both the drum and the screw, and a drive means for driving the epicyclic gear train, the improvement which comprises a second epicyclic gear train associated with the first-mentioned epicyclic gear train, the second epicyclic gear train having a drive shaft operatively connected with a control means for measuring torque between the drum and the screw and control of the rotation of the drum and the screw.

2. Separator of claim 1, and a first motor connected to the first-mentioned epicyclic gear train and the second epicyclic gear train through replaceable V-belt sheaves, said control means comprising a second motor for said measuring, said connection of the drive shaft of the second epicyclic gear train being with the second motor.

3. Separator of claim 2, the second epicyclic gear train being disposed in a bearing casing and having an output shaft which is connected through a coupling to said first motor.

4. Separator of claim 1, the second epicyclic gear train having an output shaft and the first epicyclic gear train having an input shaft, the output shaft of the second gear train being fixedly connected to the input shaft of the first gear train, and the second epicyclic gear train being rotatably mounted in the casing of the first epicyclic gear train.

5. Separator of claim 1, 2, 3, or 4, the centrifuge having an inlet for the material to be centrifuged, throttling means for said inlet, said control means being operatively connected to the throttling means.

* * * * *